US005415352A

United States Patent [19]

May

[11] Patent Number: 5,415,352

[45] Date of Patent: May 16, 1995

[54] SPRAY SYSTEM MANIFOLD APPARATUS AND METHOD

[76] Inventor: Michael W. May, P.O. Box 697, Sandia Park, N. Mex. 87047

[21] Appl. No.: 65,161

[22] Filed: May 20, 1993

[51] Int. Cl.[6] ..... B05B 7/00

[52] U.S. Cl. ..... 239/365; 239/346; 239/373; 138/44

[58] Field of Search ..... 239/373, 346, 152, 364, 239/365, 366, 1; 138/44

[56] References Cited

U.S. PATENT DOCUMENTS

| | | | |
|---|---|---|---|
| 888,693 | 5/1908 | Bustinza et al. . | |
| 1,765,398 | 6/1930 | Birkenmaier | 239/364 |
| 2,959,358 | 11/1960 | Vork | 239/330 |
| 3,802,511 | 4/1974 | Good, Jr. | 169/30 |
| 3,940,065 | 2/1976 | Ware et al. | 239/146 |
| 3,945,571 | 3/1976 | Rash | 239/152 |
| 4,991,776 | 2/1991 | Smith | 239/302 |
| 5,044,557 | 9/1991 | Smith | 239/302 |
| 5,054,687 | 10/1991 | Burns et al. | 239/373 |
| 5,058,807 | 10/1991 | Smith | 239/302 |
| 5,074,467 | 12/1991 | Geberth | 239/373 |
| 5,236,128 | 8/1993 | Morita et al. | 239/365 |

FOREIGN PATENT DOCUMENTS

| | | | |
|---|---|---|---|
| 128794 | 10/1927 | Switzerland | 239/373 |
| 19847 | of 1903 | United Kingdom | 239/373 |

*Primary Examiner*—Andres Kashnikow
*Assistant Examiner*—Christopher G. Trainor
*Attorney, Agent, or Firm*—Rod D. Baker; Deborah A. Peacock

[57] ABSTRACT

A manifold is disclosed for increasing the efficiency and consistency of air pressure driven spray systems, especially high volume, low pressure paint spraying systems. Paint or other liquid product is pushed by air pressure from a plastic bottle to the manifold, and from the manifold to a spray gun. The manifold has internal fluid passageways configured to increase the velocity of product discharge, resulting in enhanced product delivery for spray deposition, and adequate consistent discharge regardless of spray gun elevation. A customized product container lid is disclosed for use with the manifold. The apparatus maintains liquid product and pressurized air in separate lines for ease of cleaning.

32 Claims, 2 Drawing Sheets

SPRAY SYSTEM MANIFOLD APPARATUS AND METHOD

BACKGROUND OF THE INVENTION

1. Field of the Invention (Technical Field)

The invention relates to an apparatus and method for efficiently moving liquids through liquid spraying systems, in particular for the spray application of paints and lacquers.

2. Background Art

This invention relates to a system for efficient movement of liquids through spraying systems for spray application on surfaces. The apparatus and method of the invention more specifically relate to a manifold apparatus and method for use in high volume, low pressure spray systems, and a customized cap for use therewith.

It is known in the art that the application of surface treatments, such as paints, lacquers, epoxies and the like, can be accomplished using spray systems. It is generally appreciated that paints and lacquers are most rapidly and evenly applied using methods and systems for atomizing them to a spray, and then depositing the spray upon the surface to be covered. In its most commonly encountered form, the existing art consists of the ordinary can of "spray paint." The hand-held can is partially filled with liquid paint and then pressurized, with the result that the opening of a spray nozzle at the top of the can allows the pressurized gas above the contained liquid to expand and force the liquid to spray through the nozzle.

Heavy-duty industrial or construction spray painting systems are typically and essentially mere variations on the basic feature of the ordinary can of spray paint. The common existing system is characterized by the use of high pressure, low volume, air flows. The practice is to fill a metal can or "pot" with paint. The pot is provided with a threaded orifice which allows it to be screwed directly onto a triggered "spray gun." Two tubes, each of a uniform diameter, lead into the interior of the pot: one supplies high pressure to the volume above the liquid paint, the other carries flowing paint from the bottom of the pot directly to the spray nozzle of the gun. Highly pressurized air is also supplied directly to the gun. A jet stream of air at the nozzle of the gun is directed into the stream of flowing paint, thereby atomizing the paint and blowing it toward the surface to be painted.

Common alternative systems incorporate the same basic elements and configuration, but locate the pot remotely from the gun in order to allow the use of larger volume pots. A typical system in the present art is depicted at FIG. 1 of the drawings. In the existing art, pots are generally wide-mouthed and made of light metallic alloys. In such a system, the pot has two widely separated openings in its lid. One opening accommodates a lengthy product line which leads from the bottom of the pot to the spray gun. The other connects the interior of the pot with the bottom opening in a T-joint mounted in the air line. The top two openings in the T-joint are in fluid connection with the air compressor and the spray gun. Air under pressure flows from the compressor to the T-joint, thereby simultaneously delivering air pressure to the interior of the pot as well as the gun. In existing systems, product lines may be of a different diameter than air supply lines, but respective line diameters are consistently uniform throughout their lengths.

Conventional high pressure, low volume spray painting systems are replete with disadvantages. They are inefficient applicators; due to the high pressures used, much of the sprayed liquid is wasted in the form of overspray and "bounceback," with the result that droplets and fumes of the liquid solvents and pigments escape to and pollute the ambient air. Conventional high pressure, low volume systems are also difficult to clean, with the consequent loss of job time. Additionally, existing systems using remotely located product pots are prone to fouling when liquid product backs up or spills out of the pot and into the air lines. A satisfactory description of conventional high pressure, low volume systems and their drawbacks is found in U.S. Pat. No. 4,991,776 to Smith, the disclosure of which is incorporated herein by reference.

To avoid the undesirable bounceback and overspray effects associated with low volume, high pressure spraying systems, systems utilizing high volume and low pressure have been introduced into the art. Such systems employ air discharged at comparatively low pressures to atomize and apply the liquid surfactant. A high volume, low pressure spray application system is disclosed in U.S. Pat. No. 4,991,776.

A disadvantage of high volume, low pressure systems is a tendency for the liquid to be applied inefficiently due to the reduced system pressure. Optimum surface coverage occasionally is achieved only after multiple passes of the spray gun, requiring increased time and user skill. Delivery of liquid product to the gun may be inconsistent and nonuniform. Inconsistency and inefficiency of existing high volume, low pressure systems is seriously aggravated when the pot containing the liquid to be sprayed is located remotely from the spray gun, such as depicted in U.S. Pat. No. 4,991,776. In these instances, when the user elevates the gun above the level of the pot—especially, for example, when standing on a ladder to spray a ceiling—the resulting height differential, coupled with the low system pressure, seriously impedes the discharge and delivery of liquid product to the gun. Varying height differentials cause varying product discharges. The resulting slow and uneven product discharge tires the user and may adversely effect the quality of the surface finish.

U.S. Pat. No. 888,693 to Aranguren y Bustinza, entitled *Paint Machine,* discloses a device employing pressurized air and allowing the user consecutively to apply more than one color of paint without having to change paint containers or switch devices.

U.S. Pat. No. 3,802,511 to Good, Jr., entitled *Portable Fire Extinguisher,* discloses an apparatus for using air pressure to power a hand-held water pump for generating a stream of water.

U.S. Pat. No. 3,945,571 to Rash, entitled *Self-Contained Portable Pressure Apparatus and Hand Gun Assembly,* discloses a device permitting the user to carry on her back a portable vessel of pressurized air, and in her hand a triggered gun affixed below a hopper containing a surface coating mix. Pressurized air flows from the vessel, through the hopper and to the gun nozzle. The surface coating mix flows by gravity and is never under pressure.

U.S. Pat. No. 3,940,065 to Ware et al., entitled *Portable Spraying Apparatus,* discloses a self-contained device for directly pumping paint. An electrically powered, readily primed paint pump acts directly on the paint to force it through a supply line to a gun. No compressed air is utilized.

U.S. Pat. Nos. 4,991,776 and 5,044,557 and 5,058,807 to Smith, all entitled *High Volume, Low Pressure Spraying System,* disclose devices for generating a high volume, low pressure air delivery system for use in spraying applications. The device attaches to standard air compressors and converts high-pressure low-volume air flow to a low-pressure, high-volume air flow to the spray gun through the use of a Venturi induction pump. The delivery of paint, however, is by standard means of pressure pots; nothing is taught regarding the enhancement of the paint flow from the pressure pots to the spray guns.

Accordingly, there remains a need for an apparatus and method for increasing the product delivery efficiency and reliability of high volume, low pressure spraying systems. There is also a need for such an apparatus and method that minimizes the time and effort involved in cleaning the system after each use.

SUMMARY OF THE INVENTION (DISCLOSURE OF THE INVENTION)

The invention relates to a method and apparatus for increasing the operational consistency and efficiency of spraying systems, particularly spray painting systems employing high volume, low pressure discharges of compressed air. The low pressures involved in high volume, low pressure systems occasionally causes paint or other product delivery to be inconsistent or inefficient, particularly when the spray gun is elevated any substantial height above the product source. The inventor has determined that increases in product velocity head improve appreciably the consistency and efficiency of product delivery.

Accordingly, a manifold apparatus and method are provided for increasing the velocity head of the product flowing through the system. Velocity head is increased using a single- or multi-stage Venturi system, by which the flowing product is forced through two or more lengths of a conduit, each successive length having a smaller internal radial cross sectional area through which the product may flow. As the streamtube is constricted, the product velocity is increased in order to maintain a constant discharge.

The preferred embodiment of the manifold of the invention also includes various ports and passageways for supplying air pressure to a product source, such as a paint pot, as well as to the spray applicator. A customized cap is disclosed for use in attaching a product container to the manifold body. The customized cap permits the use of common, readily interchangeable plastic product containers. The cap includes elements allowing air pressure supplied from the manifold to pressurize the interior of the container, but preventing product within the container from backflowing into the air supply system.

A primary object of the present invention is to provide a means for improving the efficiency and reliability of liquid spraying systems.

Another object of the invention is to allow constant and consistent delivery of liquids through spray application systems.

Still another object of the invention is to provide a means for minimizing the effects of varying the difference between spray gun elevation and air compressor elevation in liquid spraying systems.

Still another object of the invention is to improve the efficacy of high volume, low pressure spray application systems.

A primary advantage of the present invention is that it increases the consistency and reliability of liquid product delivery from spray application systems, especially high-volume, low pressure systems.

Another advantage of the present invention is that it is easily and inexpensively manufactured.

Another advantage of the present invention is that it facilitates and encourages the use of environmentally friendly high volume, low pressure spray application systems.

Another advantage of the present invention is that it facilitates the use of commonly available plastic product containers, thus reducing waste, encouraging recycling, and easing clean-up.

Still another advantage of the present invention is that it is easily cleaned and maintained.

Still another advantage of the present invention is that it improves the uniformity and quality of spray paint coverage on surfaces.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

This invention relates to an apparatus and method for increasing the efficiency of liquid spraying systems. The preferred embodiment is particularly adaptable for use in high volume, low pressure, air systems commonly referred to as "HVLP" spraying systems. HVLP systems utilize compressed air to atomize and disburse the fluid to be sprayed, but are distinguishable from more conventional systems by the magnitude of the driving air pressure. It will be immediately appreciated by one skilled in the art that while spray paint systems typically utilize compressed air, other compressed gases may be suitably substituted. In this specification and the claims, "air," when compressed, is intended to include mixed or unmixed inert gases such as nitrogen, carbon dioxide, helium, and the like, as well as ambient air. The invention may be practiced using air compressors which compress ambient air at the job site, or may be used in conjunction with contained gases compressed off-site and delivered to the site in pressure containers.

Conventional high-pressure systems use air pressures of approximately 60 to 70 pounds per square inch (psi), but comparatively low volumes of discharged air. HVLP systems, in contrast, involve low pressures of approximately 4 to 12 psi, but discharges of comparatively larger volumes of air through the system. The advantages of HVLP spraying systems are detailed in U.S. Pat. No. 4,991,776.

This invention has utility in any circumstance where it is desired to spray a liquid. The liquid product may be a substance for surface coating, for example paint, varnish, lacquer, various resins and epoxies, or the like. Alternatively, the liquid to be sprayed may be cleaning fluids or solvents, other surface preparations, pesticides, insect repellant, or nearly any other fluid capable of being sprayed or atomized. In this specification and in the claims, "product," "liquid," or "paint" includes any fluid typically or potentially the subject of sprayed application.

Figure 1:
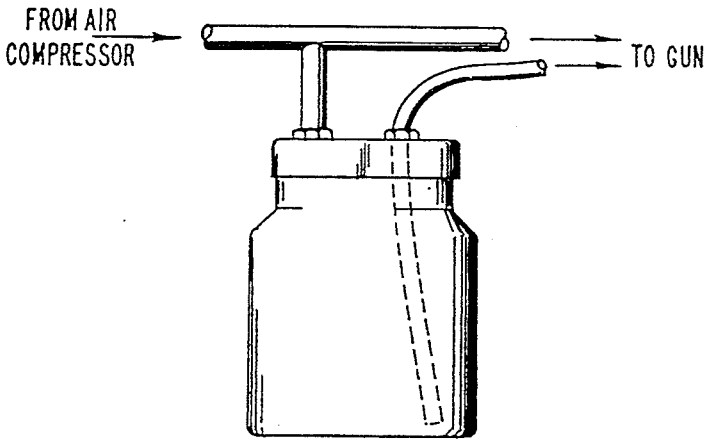
FIG-1 PRIOR ART
FIG. 1 is a side view of a spraying system pot and tubing device known in the prior art.
Figure 2:
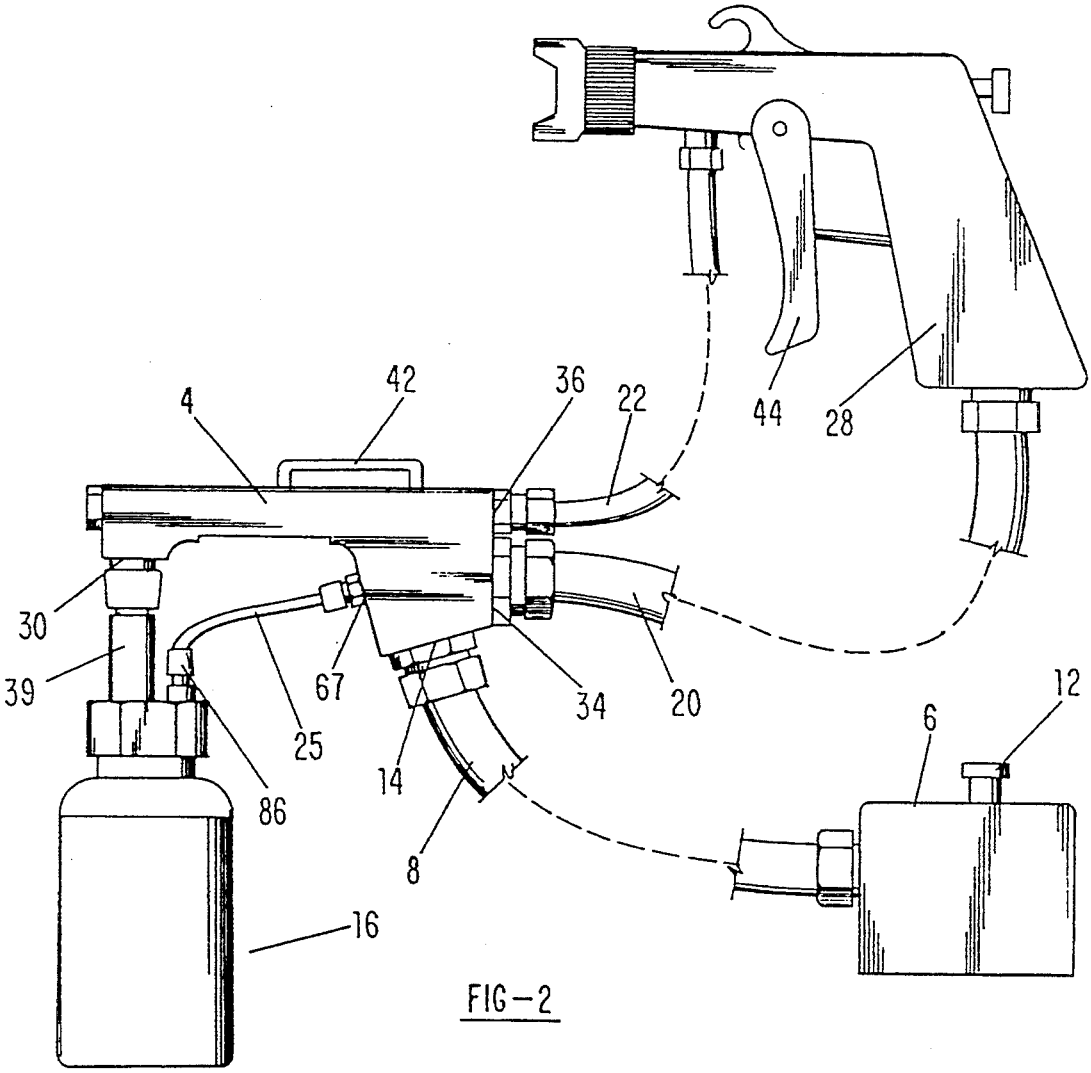
FIG. 2 shows a side view of the preferred embodiment of the invention, as used in conjunction with a spray gun and air compressor known in the art.

Attention is invited to FIG. 2, illustrating the use of the preferred embodiment of the invention in an HVLP system. The manifold apparatus of the invention is depicted generally at 4. Manifold 4 is connected to a high volume, low pressure air compressor 6 via air supply hose 8. Air compressor 6 is any compressor known in the art which delivers high volumes of compressed air at between approximately four and twelve pounds per square inch; the air compressor described in U.S. Pat. No. 4,991,776 would serve.

Air compressor 6 preferably is located a sufficient distance from the work area that any product vapors or fumes are not pulled into the system via the compressor's air intake 12. Compressor 6 preferably is wheeled and portable, and is equipped with the features, fittings, gauges, and valves standard in the art, including an adequate filter.

As indicated by FIG. 2, manifold 4 preferably is attached to a pot 16. Pot 16 may be any closed container for holding a quantity of product to be sprayed. Pot 16 preferably consists of a semi-flexible, transparent or translucent inert plastic, and is attached to manifold 4 by a customized cap 72 to be more fully described hereinafter.

Manifold 4 is configured to pass compressed air from intake port 14, through the body of manifold 4, out through air expulsion port 34 and into second air supply line 20. Air then moves through second air supply line 20 to gun 28. The interior configuration of manifold 4 also permits the passage of compressed air from air intake port 14 into the interior of pot 16 via pot pressure line 25. Product from pot 16 is driven by air pressure in pot 16 through manifold 4 and into product supply line 22, all as shall be further described. Product then moves through product supply line 22 to gun 28.

Air supply hose 8 is removably and sealably connected to the air intake port 14 of manifold 4. Second air supply line 20 and product supply line 22 are likewise connected to air expulsion port 34 and product outlet 36, respectively, of manifold 4. Connections may be by any means known in the art, such as gasketed slip-fit connectors, to provide a temporary, sealed junction. Air supply hose 8 and supply lines 20 and 22 are constructed of flexible, inert rubber or plastic as common in the art. When used with the preferred embodiment, air supply hose 8 is approximately 25 to 50 feet long, so as to allow air compressor 6 to be remotely located from the work area. Air supply hose 8 and supply lines 20 and 22 may each be fitted with a manual valve (not shown) to independently open and close each line to the passage of air or product.

Product in pot 16 moves under pressure through manifold 4, and through product supply line 22, eventually to be sprayed from gun 28 by the jet effect of air supplied through second air supply line 20. Second air supply line 20 and product supply line 22 may be of lengths adaptable to the working circumstances; manifold may be remotely located from the user and the gun 28, or manifold may be equipped with a belt clip 42 to allow manifold 4 to be clipped to the user's belt. In the latter instance, supply lines 20 and 22 may be approximately four to six feet in length; a more remotely located manifold 4 necessitates correspondingly longer supply lines 20 and 22. Alternatively, it will be appreciated by one skilled in the art that manifold 4 may be configured for attachment directly to gun Spray gun 28 is known in the art for use in conventional or HVLP systems. Spray gun 28 has two nozzles. One nozzle squirts a stream of product, the other expels a jet stream of air. Using trigger 44, the user controllably introduces product into the stream of air, causing the product to be atomized and dispersed toward the working surface. Attachment of supply lines 20 and 22 to gun 28 is by removable sealable connectors known in the art.

FIG. 2 shows a detailed side sectional view of the preferred embodiment of the manifold 4 of the invention. Manifold 4 has main body 50 preferably fashioned from cast and machined aluminum or aluminum alloy, such as 6061-T6511 aluminum alloy or the like. Alternatively, body 50 may be of any rigid, durable material that is inert to the liquid being sprayed. Body 50 preferably is of one-piece construction.

Body 50 is completely penetrated by product conduit 52. Product conduit 52 extends from clean-out opening 54 to product outlet 36. Throughout its length, product conduit 52 preferably is a cylindrical tube, e.g., has circular radial cross sections; product conduit 52 may be machined into body 50 by drilling processes. Alternative embodiments may incorporate product conduits 52 having other cross-sectional configurations.

Clean-out opening 54 is sealably blocked with clean-out plug 55 when the invention is in use. Clean out plug 55 is removably inserted into clean-out opening 54. Clean-out plug 55 and clean-out opening 54 preferably are compatibly threaded to allow secure screwed insertion and removal of clean-out plug 55. Clean-out plug 55 thus may be removed to facilitate cleaning of product conduit 52.

Figure 3:
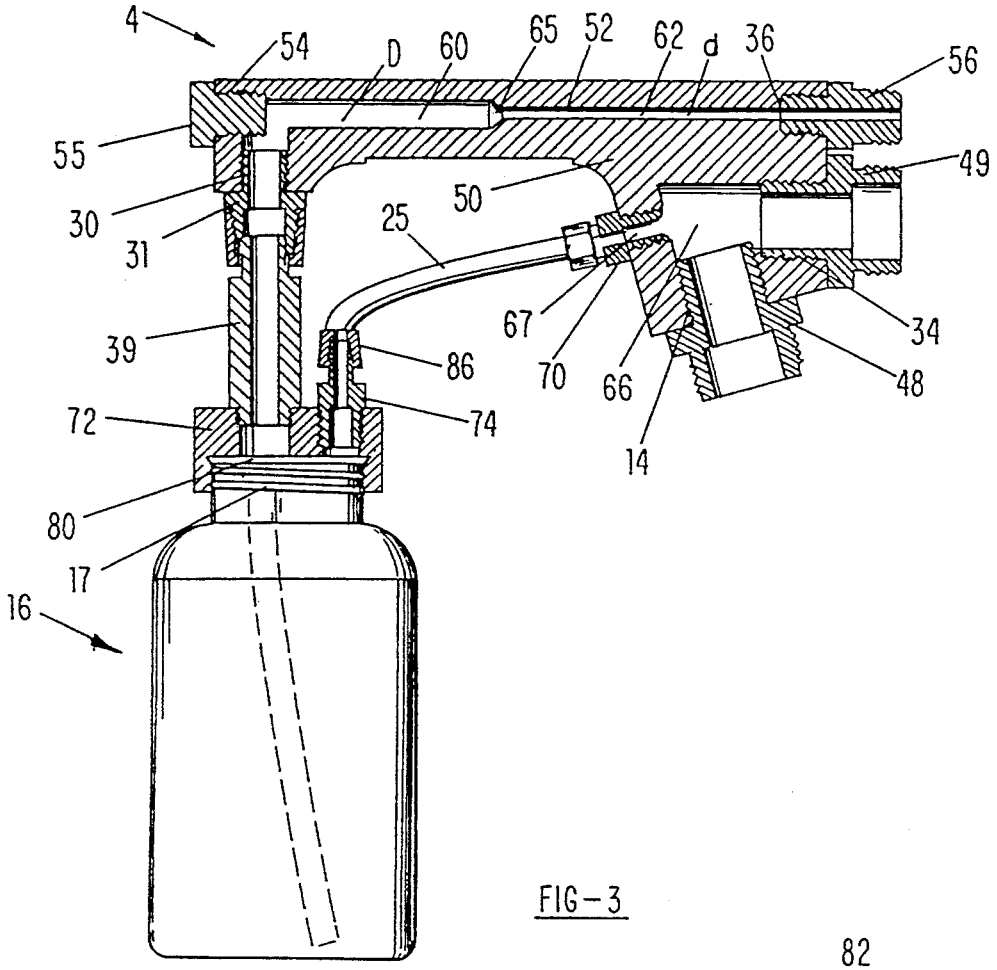
FIG. 3 is a side cross sectional view of the preferred embodiment of the invention.
Figure 4:
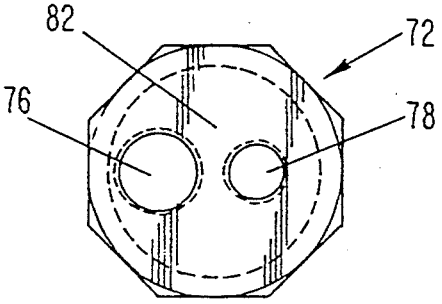
FIG. 4 is a top view of the customized cap element of the embodiment of FIG. 3.

As illustrated in FIG. 3, product conduit 52 preferably comprises two sections or lengths having distinct diameters. Product enters intake tunnel 60 of product conduit 52 via product inlet 30, and flows under pressure through outlet tunnel 62 to product outlet 36. Intake tunnel 60 and outlet tunnel 62 preferably have collinear longitudinal axes. Intake diameter D of intake tunnel 60 is greater than outlet diameter d in outlet tunnel 62. In the preferred embodiment, intake diameter D of intake tunnel 60 is approximately $\frac{3}{8}$ to 5/16 inch, while outlet diameter d of outlet tunnel 62 is approximately $\frac{1}{4}$ inch. The absolute cross sectional areas of intake tunnel 60 and outlet tunnel 62 are not critical, and may be greater or smaller in various models of the invention. Their relative sizes are critical, however, as intake tunnel 60 must always have a larger cross-sectional area than outlet tunnel 62.

Intake tunnel 60 and outlet tunnel 62 conjoin at constriction nozzle 65. Thus, the diameter of product conduit 52 is not uniform along its length, but in the preferred embodiment is abruptly reduced at constriction nozzle 65. Accordingly, product conduit 52 effectively acts as a single-stage "Venturi" constriction, and contributes to the efficiency-boosting aspect of the invention.

Alternative embodiments of the invention may locate constriction nozzle 65 practically anywhere along the length of product conduit 52, provided that product inlet 30 intersects intake tunnel 60 so that product always moves from a tube or conveyance of greater cross section to one of comparatively lesser cross section. Moreover, satisfactory alternative embodiments of the invention may modify constriction nozzle 65, so that the reduction in cross section of product conduit 52 occurs gradually with a lesser or no abrupt constriction. Ideally, constriction nozzle 65 has rounded or tapered surfaces for a smooth reduction in cross section; extremely abrupt or square-edged constrictions may cause an undesirable loss of energy or "head" across the constriction 65. The embodiment having a constriction nozzle 65 configured and located as illustrated in FIG. 3 offers ease of manufacture without appreciable loss of efficiency.

It will also be noted that additional alternative configurations of product conduit 52 may incorporate a series of intermediate product tunnels between intake tunnel 60 and outlet tunnel 62. In these alternative embodiments, one or more intermediate product tunnels are disposed in a series, e.g. end-to-end, between inlet tunnel 60 and outlet tunnel 62. All product tunnels are linked by constriction nozzles similar to constriction 65, such that product flowing from product inlet 30 to product outlet 36 is always flowing from a tunnel having a greater cross section to a tunnel of lesser cross section. The respective cross-sectional areas of all product tunnels should be progressively smaller-and must never increase—proceeding from product inlet 30 to product outlet 36. Thus, tunnels more proximate to inlet 30 will have larger bores than tunnels more remote therefrom, with the smallest tunnel being outlet tunnel 36.

Alternative embodiments of the invention may adapt the shape of body 50 to incorporate an intake tunnel 60 and/or an outlet tunnel 62 that are curved or angled or otherwise without a rectilinear longitudinal axis, particularly in embodiments of manifold 4 adapted to attach directly to a spray gun 28. The key feature of product conduit 52 is that it be configured to increase fluid velocity with minimal energy loss.

Product outlet 36 preferably receives outlet adapter Outlet adapter 56 preferably is composed of a durable alloy, such as brass or steel. Outlet adapter 56 and product outlet preferably are compatibly threaded to allow screwed insertion of adapter 56 into product outlet 36. It is essential to the proper practice of the invention that the inside diameters of outlet adapter 56 and product supply line 22 be equal to or less than the diameter d of outlet tunnel 62 of product conduit 52. Product outlet adapter 56 functions to allow easy, repeated, conventional attachment and detachment of a product supply line 22 to manifold 4. Alternatively, product outlet 36 may be so configured as to allow attachment of product supply line 22 directly to the body 50 of manifold 4. It is intended that product outlet 36, with or without the use of an adapter 56, allows standard product supply lines common in the art to be readily used in conjunction with manifold 4.

Product inlet 30 in body 50 is an orifice located in the proximity of clean-out opening 54, and preferably has a circular cross section. As shown in FIG. 3, product inlet 30 penetrates body so as to intersect product conduit 52. The intersection may, but need not, be at right angles; but the juncture of product inlet 30 with product conduit 52 must be such that liquid product flows smoothly from pot 16 to intake tunnel 60. Importantly, in the preferred embodiment the cross-sectional area of product inlet 30 is at least as great as the cross-sectional area of intake tunnel 60. The diameter of product inlet 30 is never less than diameter d of outlet tunnel 62.

Product inlet 30 preferably receives inlet adapter 31. Inlet adapter 31 preferably is composed of a durable alloy, such as brass or steel. Inlet adapter 31 and product inlet 30 preferably are compatibly threaded to allow screwed insertion of adapter 31 into product inlet 30. Product inlet adapter 31 functions to allow easy, repeated, conventional attachment and detachment of a pot 16 to manifold 4, using a slip-fit connector 39. Alternatively, product inlet 30 may be so configured as to allow attachment of a connector 39 or other means of product delivery directly into body 50 of manifold 4. It is intended that product inlet 30, with or without the use of an adapter 31, allows standard connectors common in the art to be readily used in conjunction with manifold 4. The radial cross-sectional area of the interior tube of connector 39 preferably is at least a great as the corresponding cross-sectional area of product inlet 30.

Maximum advantages of the invention are realized when product flows into passages of increasingly smaller cross sections. The cross sectional area of product flow through connector 39 preferably exceeds that of product inlet 30, which in turn preferably exceeds that of intake tunnel 60. In any and all embodiments, outlet tunnel 62 has a lesser cross section for product flow than all the upstream components.

The efficiency-increasing advantage of the invention is based in major part upon fundamental principles of fluid mechanics. The first applicable principle is the law of conservation of mass, as expressed in the "continuity equation." The continuity equation states that in steady fluid flow, the flux of mass along a streamtube (such as product conduit 52) is constant. The second applicable principle is that of the conservation of energy, and in fluid dynamics is expressed using the "energy equation," frequently called the "Bernoulli equation."

The continuity equation can be used to demonstrate that a transition (either a constriction or an expansion) in a streamtube will change the velocity of a fluid moving therethrough proportionally to the change in the streamtube's cross sectional area, such that total discharge remains constant. For most commonly encountered, e.g. incompressible, liquids, the continuity equation can be written for volume flux or discharge as $$Q=G_2V_2A_2V_2$$

where Q is discharge, $A_1$ is the streamtube's cross-sectional area at a location 1 immediately upstream from the transition, $V_1$ is the average fluid velocity through the plane of $A_1$, $A_2$ is the streamtube's cross-sectional area at location 2 immediately downstream from the transition, and $V_2$ is the average fluid velocity through the plane of $A_2$. It is readily observed that a reduction in cross-sectional area (e.g. a constriction in the streamtube) results in a directly proportional increase in fluid velocity in order for volume discharge to remain constant. In the present invention, location 1 is within intake tunnel 60 and location 2 is within outlet tunnel 62 of product conduit 52.

Solution of the Bernoulli equation can demonstrate, within the confines of certain assumptions, that energy is conserved when a fluid passes through a streamtube transition. If it is assumed that shear and drag forces attributable to friction between the moving fluid and the walls of the conduit are zero, and that no other heat energy or any mechanical energy is lost from the system (all acceptable assumptions in the present invention), the energy of the system upstream of a transition will be the same as the system energy downstream of the transition. Assuming no heat or mechanical energy losses, the equation can be expressed as:

$$\frac{V_1^2}{2g}+\frac{P_1}{\gamma}+z_1=\frac{V_2^2}{2g}+\frac{P_2}{\gamma}+z_2$$

where $V_1$ is the velocity of the fluid at point 1 immediately upstream from the transition, g is the gravitational constant, $P_1$ is the internal pressure at point 1, $\gamma$ is the specific weight of the fluid, $z_1$ is the elevation of point 1, $V_2$ is the velocity of the fluid at point 2 immediately downstream from the transition, $P_2$ is the internal pressure at point 2, and $z_2$ is the elevation (comparative height) of point 2. If, as in the case of the preferred embodiment of the invention, the intake and the outlet of the constriction are at essentially the same elevation, the elevations $z_1$ and $z_2$ (which affect pressure) can be neglected; therefore:

$$\frac{V_1^2}{2g}+\frac{P_1}{\gamma}=\frac{V_2^2}{2g}+\frac{P_2}{\gamma}$$

where $$\frac{V^2}{2g}$$

is the "velocity head", and $$\frac{P}{\gamma}$$

is the "pressure head." These are two principal components of energy in the system. Solution of the equation shows that, as between a point 1 upstream from a transition and point 2 downstream from a transition, an increase in velocity head must be accompanied by a decrease in the pressure head, and visa-versa. In the present invention, point 1 is within intake tunnel 60 and point 2 is within outlet tunnel 62 of product conduit 52. Neglecting the loss of head attributable to the transition (in the case of the present invention, a coefficient of contraction) energy is conserved when velocity changes are offset by internal pressure changes.

It is noted that an increase in the velocity head causes a decrease in the pressure head, in order for energy to be conserved. Per the continuity equation, a constriction in the stream tube will increase the velocity of the fluid downstream from the constriction, which in turn increases the velocity head and decreases the pressure head.

In the present invention, minor losses, e.g. drag, shear, and coefficient of contraction, are comparatively inconsequential, while the increased velocity head contributes substantially to the advantages of the invention. As product passes from intake tunnel 60 to outlet tunnel 62, the velocity head is increased. In HVLP systems in particular, this increased velocity head, caused by constriction nozzle 65, results in a more efficient, consistent product delivery through product supply line 22.

Combined reference is made to FIGS. 2 and 3. Manifold 4 also serves to supply air pressure to pot 16. Compressed air passes from air supply hose 8 through air intake port 14 and into chamber 66. Penetrating body 50 and intersecting chamber 66 is pot pressure port 67, which permits the transfer of air pressure from chamber 66 to pot pressure line 25. In the preferred embodiment, pot pressure port 67 is an orifice of circular diameter, threaded to allow the screwed insertion of pot pressure line adapter 70. Pot pressure line adapter 70 is analogous to the adapters 56 and 31 previously described, and is configured to accommodate the easy and repeated attachment and detachment of pot pressure line 25 to pot pressure port 67. Any screwed or slip-fit temporary, sealed connection common in the art is satisfactory.

Air pressure is supplied to manifold 4 via air supply hose 8. Air enters manifold 4 via air intake port 14, whereupon it enters chamber 66. In the preferred embodiment, a brass or stainless steel air supply hose adapter 48 is screwed or otherwise removably and sealably inserted into air intake port 14. Adapter 48 permits ready attachment and detachment of air supply hose 8 to manifold 4 using slip-fit or other common connectors known in the art. A similar adapter 49 serves an identical purpose respecting air expulsion port 34.

Air intake port 14 and air supply hose 8 preferably have diameters equalling a standard diameter, such as $\frac{3}{4}$ inch, commonly used in the industry. Air expulsion port 34 and second air supply line 20 preferably also have equal diameters, and preferably have a common diameter, such as $\frac{5}{8}$ inch, which is less than the diameter of air intake port 14. The flow of air is bifurcated in chamber 66, with the greatest discharge exiting manifold 4 via air expulsion port 34 to continue on to gun 28 via second air supply line 20. A comparatively small air discharge exits chamber 66 through pot pressure port 67 to maintain air pressure in the pot 16. The velocity of the flow of air through second supply line 20 exceeds the velocity in air supply hose 8, despite the loss of air through pot pressure port 67, due to the comparatively smaller diameter of second air supply line 20.

Continued reference is made to FIG. 3. Pot 16 contains the product to be sprayed. Pot 16 may be of any practicable volume. If manifold 4 is intended to be hung on the user's belt, pot 16 preferably is a pint bottle; remotely located manifolds can be designed to accommodate pots of larger contained volumes. In the preferred embodiment, pot 16 has a threaded neck 17 and is composed of transparent or translucent plastic, e.g. polypropylene, polyvinylchloride, polyethylene, that is inert to common petroleum solvents. Suitable bottles are available off-the-shelf, and an advantage of the invention is its adaptation for use with commonly available plastic bottles. Prior to the operation of the invention, the desired quantity of product is placed in pot 16; pot 16 may be nearly filled, provided a small volume of trapped air remain above the contained product surface. Air pressure from pressure line 25 pressurizes the trapped air volume above the product, forcing product from the pot 16.

Air pressure is delivered to pot 16 via pot pressure line 25. Pot pressure line 25 is connected to cap inlet adapter 74, which is inserted into air aperture 78 in cap 72. Anywhere along pot pressure line 25 is disposed a check valve 86. Check valve 86 is a one-way valve which permits air to move from pressure line 25 into pot 16, but bars the flow of product from the interior of pot 16 into pressure line 25. Accordingly, the pot 16 and manifold 4 may be upset, or operated in nearly any orientation except upside down, without product backing up through pot pressure line 25. An advantage of the invention is that the manifold can be tipped over during use (a common occurrence with remotely located manifolds and a busy operator) without paint flowing into and fouling chamber 66 or air supply lines 8 or 20 or other air passageways and conveyances of the system.

FIG. 3 illustrates the use of customized cap 72 upon pot 16 in the preferred embodiment of the invention. Cap 72 is designed and manufactured so to screwably attach to the mouth of pot 16. Cap 72 also is designed to receive a cap inlet adapter 74 and a slip-fit connector 39.

An advantage of the preferred embodiment of the invention is the increased operational flexibility of the use of customized cap 72 in conjunction with transparent plastic pot 16. Presently in the art, pot 16 is typically made of comparatively expensive lightweight metal, and the attachment of the metal pot to the air supply is by means of a lid fitting the metal pot—but few, if any, other types of containers. As a result, only one or two metal pots are used in a particular system rig. The metal pot must be emptied and cleaned every time the type of product or color of paint is changed. Moreover, paints and lacquers stick to metal surfaces, making metal pots difficult to clean, with the result that work crews expend valuable time cleaning the pot (or avoid the unpleasant task altogether, thus compounding the cleaning problem).

Customized cap 72 of this invention fosters the use of clear or translucent plastic pots 16. Plastic pots are relatively inexpensive, so a set of many pots (of uniform or assorted volumes) may be included in a system rig. This encourages interchangeability; when a product change is indicated, the user merely removes the pot containing the unused portion of product, screws a sealing cap on it, and stores it for later use. A replacement pot containing the alternative product is then screwed into place. The process may be repeated indefinitely, using a full inventory of products stored in their respective transparent pots. Moreover, most paints are readily washed from plastic pots, facilitating clean-up.

The use of flexible plastic pots also increases the overall operational consistency of the system of the invention. When the interior of a plastic pot 16 is pressurized, the pot 16 elastically expands slightly, temporarily storing energy. When pressure in the interior of the pot 16 drops, the potential energy stored in the stretched walls of the pot 16 is released, momentarily and slightly increasing interior pressure. Such expansion and contraction of pot 16 may be rapidly repeated, thus stabilizing the interior pressure within pot 16 despite minor repeated pressure fluctuations originating in the air compressor.

FIGS. 4–7 depict cap 72 in isolation. Cap 72 preferably is cast or machined from hard lightweight metallic alloy, such as 60601-T6511 aluminum alloy or the like, but alternatively may be machined or cast from other alloys or plastics. Cap threads 73 are machined as to depth, pitch, relief, internal diameter and the like to correspond to the threaded neck on pot 16. Cap 72 may accordingly be securely screwed over the opening in pot 16, as shown in FIGS. 2 and 3.

Top 82 of cap 72 is completely penetrated preferably at right angles by product aperture 76 and air aperture 78. Product aperture 76 and air aperture 78 preferably are parallel to each other, and both are internally threaded. The threads of product aperture 76 correspond to the exterior threads of slip fit connector 39 to allow standard connector 39 to be removably screwed into product aperture 76, as shown in FIG. 3. Similarly, the interior threads of air aperture 78 correspond to the exterior threads of cap inlet adapter 74, such that cap inlet adapter 74 can be removably screwed into air aperture 78 as depicted in FIG. 3. Alternative means for sealably attaching a connector 39 and cap inlet adapter 74 to the cap 72 are also within the spirit of the invention.

Figure 5:
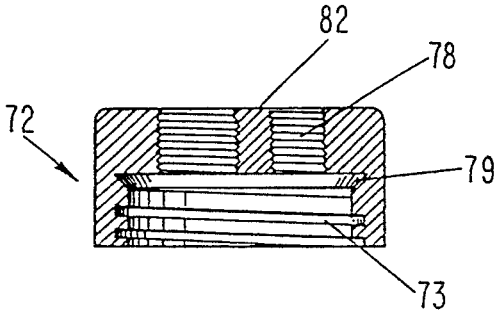
FIG. 5 is a side view of the element of FIG. 4, with a portion broken away to show certain interior features.
Figure 6:
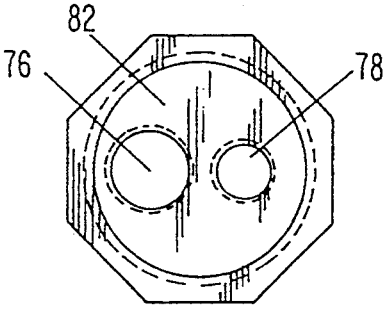
FIG. 6 is a bottom view of the element of FIG. 4.
Figure 7:
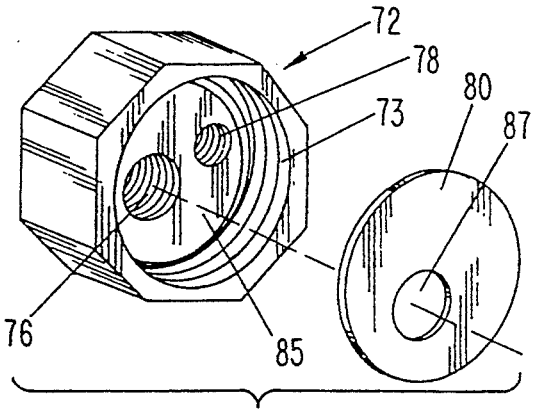
FIG. 7 is a perspective view of the element of FIG. 4, showing its use in conjunction with a special gasket.

Particular reference is made to FIG. 5, which shows that the relief in threads 73 is machined with annular recess 79 around the entire circumference. When cap 72 is in use, recess 79 accepts the edge of gasket 80, which is inserted into cap 72 as shown in FIG. 7. Gasket 80 is seated directly against inside top 85 of cap 72, and seals the contact between pot 16 and cap 72 against leakage of product when the invention is in use.

As illustrated by FIG. 7, gasket 80 is a thin planar disc with a diameter corresponding to the inside diameter of cap 72 at the location of recess 79. Gasket 80 preferably is made of a flexible elastic material. Gasket 80 is pierced by a single product venthole 87. When gasket 80 is properly installed within the inside of cap 72, venthole 87 is aligned with product aperture so that product can pass from pot 16, via an interior product tube, through venthole 87 and product aperture 76. Venthole 87 has a diameter slightly larger than the diameter of product aperture As shown in FIG. 3, the interior product tube is disposed within the interior of pot 16, and leads from the bottom of pot 16 to product aperture 16 in cap 72, as commonly practiced in the art to allow the interior of pot 16 to be completely evacuated of its contents.

It is observed that gasket 80 does not have a hole therethrough corresponding to air aperture 78. In the preferred embodiment, gasket 80 acts as a reed valve to prevent product from exiting the interior of pot 16 via the air aperture 78. When the invention is in active use, compressed air passes through air aperture 78 in cap 72. The air pressure deflects gasket 80 slightly to allow air to flow between gasket 80 and the inside top 85 of cap 72, until the flow reaches venthole 87. Upon reaching venthole 87 (whose diameter slightly exceeds the diameter of the interior product tube), the pressurized air passes through the venthole 87 and into the interior of pot 16. The flow of air through venthole 87 prohibits product in pot 16 from leaking through venthole 87. If the air flow through pot pressure line 25 is valved off, or if air flow through air aperture 78 is otherwise discontinued, gasket 80 everywhere snaps back to contact inside top 85 of cap 72, thus sealing the interior of pot 16 against the flow of product into air aperture 78. Thus, gasket 80 effectively acts as a reed valve back-up to check valve 86, and prevents paint from entering any passageways intended to deliver only air.

An advantage of the invention over the existing art is apparent; the present invention may be upset or tipped over without product entering into the air lines and thus impairing efficiency and drastically complicating clean-up. Clean-up is also simplified by the interchangeability of pots. At the conclusion of a particular stage of a spraying project, a pot containing product may be removed from manifold 4 by disconnecting connector 39 from manifold 4 and cap inlet adapter 74 from pot pressure line 25. The plastic pot 16 containing any unused product can be sealably capped and set aside for later use; a transparent plastic pots 16 allows visual identification of the contents of stored pots. A replacement pot containing turpentine, water, or other solvent may then be attached to manifold 4, the air pressure through second air supply line 20 valved off (causing air flow only through pot pressure line 25). Solvent is forced from the pot through manifold 4 and product supply line 22 to clean out product residues.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A product spraying system comprising:
- a manifold body;
- a product inlet in said body;
- a product outlet in said body;
- means for passing product unmixed with air through said body from said inlet to said outlet, said means for passing comprising a conduit comprising progressively smaller cross sections;
- means, in fluid communication with said product outlet, for applying said product to a surface; and
- means for fluidly transporting air, unmixed with product, through said manifold body to said means for applying said product.

2. The system of claim 1, further comprising a belt clip disposed upon said body.

3. A method of spraying a product comprising the steps of:
- (a) compressing a gas;
- (b) placing a manifold in fluid communication with a product applicator;
- (c) transmitting the compressed gas through the manifold to a source of a product, thereby pressurizing the product;
- (d) pumping compressed gas through the manifold and toward the product applicator;
- (e) propelling through the manifold and to the product applicator a product stream unmixed with the gas;
- (f) progressively increasing the velocity head of the product stream by forcing the stream through a manifold conduit of decreasing cross section.

4. The method of claim 3 wherein the step of placing a manifold comprises the step of locating the manifold remotely from the applicator.

5. The method of claim 4 wherein the step of placing the manifold comprises disposing a flexible hose between the manifold and the applicator.

6. A spraying system comprising:
- a manifold body;
- at least one product inlet in said body;
- at least one product outlet in said body;
- a product conduit through said body and connecting said product inlet with said product outlet, said conduit comprising:
  - an intake tunnel connected to said product inlet;
  - an outlet tunnel connected to said product outlet; and
  - wherein each said tunnel comprises a cross sectional area;
- means for conveying product unmixed with air from said product outlet to a product applicator; and
- means for fluidly transporting air, unmixed with product, through said manifold body to said product applicator.

7. The apparatus of claim 6 wherein said cross sectional area of said intake tunnel comprises a cross sectional area greater than said cross sectional area of said outlet tunnel.

8. The apparatus of claim 7 wherein said product conduit further comprises at least one intermediate tunnel connecting said intake tunnel with said outlet tunnel, and wherein each said intermediate tunnel comprises a cross sectional area lesser than said cross sectional area of said intake tunnel and greater than said cross sectional area of said outlet tunnel.

9. The apparatus of claim 8 wherein said cross sectional areas of said intermediate tunnels comprise progressively decreasing cross sectional areas, wherein said cross sectional areas disposed proximally to said inlet tunnel exceed said cross sectional areas of said tunnels disposed distally from said inlet tunnel.

10. A spraying system manifold apparatus comprising:
- a manifold body;
- at least one air intake port in said body;
- at least one air expulsion port in said body;
- at least one product inlet in said body;
- a customized cap, fluidly connectable to said product inlet, comprising:
  - a top;
  - an air aperture in said top;
  - a product aperture in said top;
  - an annular recess proximate to said top; and
  - valve means, disposed in said recess, for interrupting the flow of air through said air aperture;
- at least one product outlet in said body; and
- a product conduit through said body and connecting said product inlet with said product outlet.

11. The apparatus of claim 10 wherein said interrupting means comprises a flexible gasket disposed against said top and covering said air aperture, said gasket comprising a venthole corresponding to said product aperture.

12. The apparatus of claim 10 further comprising means for transmitting air pressure from said air intake port in said body to said air aperture in said customized cap.

13. The apparatus of claim 12 further comprising a product source wherein said product source comprises a pot.

14. The apparatus of claim 13 wherein said pot comprises a plastic pot.

15. The apparatus of claim 13 wherein said transmitting means comprises:

a pot pressure port in said body and in fluid connection with said air intake port; and a pot pressure line disposed between said pot pressure port and said air aperture in said customized cap.

16. A spraying system method comprising:

(a) providing a body;

(b) disposing at least one air intake port in the body;

(c) disposing at least one air expulsion port in the body;

(d) placing at least one product inlet in the body;

(e) connecting a product source to the product inlet;

(f) placing at least one product outlet in the body; and (g) connecting the product inlet to the product outlet with a product conduit through the body;

(h) passing through the body and toward a product applicator compressed air unmixed with the product; and (i) forcing product through the product conduit from the product inlet to the product outlet.

17. The method of claim 16 wherein the step of connecting the product inlet to the product outlet comprises the steps of:

(a) connecting an intake tunnel to the product inlet; and (b) connecting an outlet tunnel to the product outlet; wherein each of the tunnels has a cross sectional area.

18. The method of claim 17 wherein the step of connecting an outlet tunnel comprises the step of connecting an outlet tunnel having a cross sectional area less than the cross sectional area of the inlet tunnel.

19. The method of claim 18 comprising the further step of connectably disposing at least one intermediate tunnel between the intake tunnel and the outlet tunnel, wherein the intermediate tunnel has a cross sectional area lesser than the cross sectional area of the intake tunnel and greater than said cross sectional area of the outlet tunnel.

20. The method of claim 19 wherein the step of connectably disposing at least one intermediate tunnel comprises providing intermediate tunnels having progressively decreasing cross sectional areas according to their decreasing proximity to the inlet tunnel.

21. A spraying system method comprising the steps of:

(a) providing a manifold body;

(b) disposing at least one air intake port in the body;

(c) disposing at least one air expulsion port in the body;

(d) placing at least one product inlet in the body;

(e) providing a customized cap;

(f) piercing the cap with an air aperture;

(g) piercing the cap with a product aperture;

(h) placing an annular recess in the cap; and (i) disposing a valve in said recess for interrupting the flow of air through the air aperture;

(j) placing at least one product outlet in the body;

(k) fluidly connecting the product inlet to the product outlet with a product conduit through the body; and (l) forcing product through the product conduit from the product inlet to the product outlet.

22. The method of claim 21 wherein the step of dispersing a valve comprises inserting a flexible gasket against the cap and thereby covering the air aperture, while aligning a venthole in the gasket with the product aperture.

23. The method of claim 21 comprising the further step of transmitting air pressure from the air intake port in the body to the air aperture in the customized cap.

24. The method of claim 23 comprising the further step of attaching a pot to the customized cap.

25. The method of claim 24 wherein the step of attaching a pot comprises attaching a plastic pot.

26. The apparatus of claim 24 wherein the step of transmitting air pressure comprises the steps of:

(a) disposing a pot pressure port in the body and in fluid connection with the air intake port;

(b) disposing a pot pressure line between the pot pressure port and the air aperture in the customized cap; and (c) forcing air from the air intake port through the pot pressure line and through the air aperture and into the pot.

27. A method of improving the efficiency of spraying products comprising the steps of:

(a) providing a manifold body;

(b) placing a product inlet in the body;

(c) placing a product outlet in the body;

(d) fluidly connecting the product inlet and the product outlet with a product conduit of varied cross section disposed in the manifold body;

(e) fluidly connecting a product container to the product inlet;

(f) forcing product from the product container through the body to the product outlet;

(g) increasing the velocity head of the product by forcing product through the product conduit as it flows from the product inlet to the product outlet;

(h) transporting product unmixed with air from the product outlet; and (i) transporting air, unmixed with product, through the manifold body to a means for applying the product.

28. The method of claim 27 wherein the step of increasing the velocity head of the product comprises the step of decreasing the pressure head.

29. The method of claim 27 wherein the step of increasing the velocity head comprises the step of forcing the product through a series of at least two tunnels having progressively smaller cross-sectional areas.

30. The method of claim 27 wherein the step of forcing product from the product container comprises the step of pressurizing the container.

31. The method of claim 27 comprising the further steps of:

(a) supplying pressurized air to an air intake port in the body;

(b) expelling air from an air expulsion port in the body; and (c) disposing a pressure port in the body and in fluid connection with the air intake port.

32. The method of claim 30 wherein the step of pressurizing the product container comprises the step of transmitting air pressure from the pressure port to the product container.

* * * * *